US005921628A

United States Patent [19]

Glockl

[11] Patent Number: 5,921,628

[45] Date of Patent: Jul. 13, 1999

[54] PENDULATING STOOL

[76] Inventor: Josef Glockl, Ammerseestrasse 6, 85551 Kirchheim, Germany

[21] Appl. No.: 08/875,855

[22] PCT Filed: Jan. 30, 1996

[86] PCT No.: PCT/EP96/00375

§ 371 Date: Aug. 6, 1997

§ 102(e) Date: Aug. 6, 1997

[87] PCT Pub. No.: WO96/28488

PCT Pub. Date: Sep. 19, 1996

[30] Foreign Application Priority Data

Feb. 8, 1995 [DE] Germany ..... 195 04 121

[51] Int. Cl.[6] ..... A47C 1/02

[52] U.S. Cl. ..... 297/338; 297/344.19; 297/344.18

[58] Field of Search ..... 297/338, 344.19, 297/344.18, 314, 325, 311, 195.11, 259.4, 264.1, 302.4; 248/130, 133, 371, 372.1, 629

[56] References Cited

U.S. PATENT DOCUMENTS 4,932,719 6/1990 Gonzalez Y. Rojas ..... 297/338

5,556,170 9/1996 Lai et al. ..... 297/344.19 X

FOREIGN PATENT DOCUMENTS

| | | |
|---|---|---|
| 1480037 | 5/1996 | France . |
| 19 81 518 | 3/1968 | Germany . |
| U 7531129 | 10/1975 | Germany . |
| 28 43 175 | 4/1980 | Germany . |
| 82 06 113 | 8/1982 | Germany . |
| 32 07 941 | 9/1983 | Germany . |
| 42 10 098 | 9/1993 | Germany . |
| 42 10 099 | 9/1993 | Germany . |
| WO 93/19645 | 10/1993 | Germany . |

*Primary Examiner*—Laurie K. Cranmer
*Attorney, Agent, or Firm*—Stroock & Stroock & Lavan LLP

[57] ABSTRACT

The invention concerns a rocking stool having a seat portion (1), an intermediate portion (13) and a base portion (2), wherein the intermediate portion (3) is mounted tiltably and returnably on the base portion (2). The intermediate portion (3) comprises a central pillar (4) and a spring structure (5). The central pillar (4) and the spring structure (5) are connected in series in the flow of force of the seat weight between the seat portion (1) and the base portion (2) and a bearing guide is provided between the central pillar (4) and the spring structure (5).

22 Claims, 4 Drawing Sheets

PENDULATING STOOL

FIELD OF THE INVENTION

The invention relates to a rocking stool having a seat portion, an intermediate portion and a base portion, wherein the intermediate portion is mounted tiltably and returnably on the base portion.

BACKGROUND OF THE INVENTION

A rocking stool of that kind is known from German Utility Model No. 75 31 129. That however involves less a stool than a working seat for workers who are obliged to stand at the working station. That working seat has a saddle seat which is adjustable in respect of height and which follows any movement of the person using the seat. A ball joint disposed above a plate base permits the rocking movement and a tension spring mechanism which is integrated in the plate base provides for automatic return into the neutral position. Adjustment in respect of height of the seat and a limited springing effect are afforded by way of a gas pressure spring which is integrated in the intermediate portion.

That working seat or rocking stool suffers from the disadvantage that it is only limitedly sprung on the longitudinal axis of the intermediate portion, by way of the gas pressure spring, and thus a swing movement about the longitudinal axis of the intermediate portion is not possible.

SUMMARY OF THE INVENTION

The object of the invention is so to develop a rocking stool that it permits actively dynamic seating thereon, that is to say which in addition to the rocking movement permits a swinging movement while performing normal sitting activity on the longitudinal axis of the intermediate portion in the deflected condition.

According to the invention that object is attained in that the intermediate portion comprises a central pillar and a spring structure and the central pillar and the spring structure are connected in series in the flow of force of the seat weight between the seat portion and the base portion and a bearing guide is provided between the central pillar and the spring structure.

The fact that the intermediate portion is in the form of a central pillar and a spring structure and the compact arrangement of the central pillar and the spring structure, as well as the provision of the bearing guide for the relative movement which occurs here between the central pillar and the spring structure make it possible, with the overall dimensions of a stool, to provide a springing movement on the longitudinal axis of the intermediate portion, such movement ensuring a comfortable active-dynamic swinging motion, over a long spring travel, while sitting on the stool.

Advantageously the central pillar and the spring structure are arranged concentrically, wherein here the spring structure has a dynamic and a static spring mounting, between which a spring is disposed. The bearing guide is desirably arranged between the central pillar and the static spring mounting.

Advantageously the central pillar is in the form of a spring pillar which is adjustable in respect of its length, such as for example a gas spring, and has at least one vertical guide track which co-operates with the bearing guide.

The bearing guide desirably includes a two-part bearing means which is arranged at a spacing in respect of height, with balls or rollers preferably being used as bearing elements.

In a particularly preferred embodiment the bearing elements are pressed under a spring loading against the guide track. When using bearing elements which are not subjected to a spring force, manufacturing inaccuracies are very severely perceptible in the rocking and swinging movement, and have a highly disturbing and troubling effect in terms of active-dynamic seating on the stool.

It is desirable to arrange at least two bearing elements on the guide track, for each bearing means.

In that arrangement the bearing elements are advantageously held in bearing element mountings, wherein the bearing element mountings press the bearing elements against the guide track by way of compression springs, or by way of an elastically deformable region, or by way of an elastically deformable projection. The compression springs or the elastically deformable region or the projections urge the bearing elements radially inwardly.

The guide track is desirably in the form of a tube whose first end is connected to the lower end of the spring pillar and whose second end is connected to the dynamic end of the spring mounting.

It is further desirable to arrange a sliding or plain bearing bush between the guide track tube and the spring pillar which is preferably in the form of a gas spring. In the event of an actively dynamic continuous rocking-swinging movement about the longitudinal axis of the intermediate portion, it is the spring structure that springs primarily, while the gas spring springs only to a minimum extent, so that the plain bearing bush is used primarily in regard to adjustment in respect of height.

The bearing guide is preferably arranged on a support leg main body in which the bearing mountings are radially displaceably held under a spring loading. The spring-loaded bearing elements provide for compensation in respect of dimensional inaccuracies and the arrangement thus provides a uniform trouble-free and almost soundless swinging movement about the longitudinal axis of the intermediate portion.

The support leg main body can preferably be fitted onto the base portion by way of spline connection.

It is desirable that the spacing between the dynamic and the static spring mounting can be adjusted. For that purpose a rotatable union nut is provided as a spring support means on the support leg main body, by way of which nut the spring can be prestressed. The prestressing of the spring makes it possible to adjust the rocking stool to the weight of the persons so that the seat surface does not move downwardly unacceptably far or little, when a person sits on the stool. That prestressing mechanism is advantageously formed by way of a rotatable union nut on the support leg main body, by way of which the spring can be prestressed or relieved of load by turning the union nut.

The return device is desirably in the form of a rubber-metal swing assembly between the intermediate portion and the base portion and can be set by way of a hand wheel in respect of the return force. For an ideal rocking movement it is highly desirable that the intermediate portion can be tilted about a point near to the ground or floor in the base portion.

DESCRIPTION OF THE DRAWING FIGURES

The invention is described in greater detail hereinafter by means of embodiments illustrated in the drawing in which:

FIG. 1 is a side view, half in section, of the rocking stool,

FIG. 2 is a view on a larger scale of the lower part of the intermediate portion in FIG. 1, FIG. 3 shows the region of the intermediate portion with the bearing guide, FIG. 4*a* is a view in cross-section through the intermediate portion in the region of the bearing guide, FIG. 4*b* shows a part of the FIG. 4*a* structure on an enlarged scale, and FIG. 4*c* shows an alternative construction of the FIG. 4*b* structure.

DESCRIPTION OF THE PREFERRED EMBODIMENTS

Figure 1:
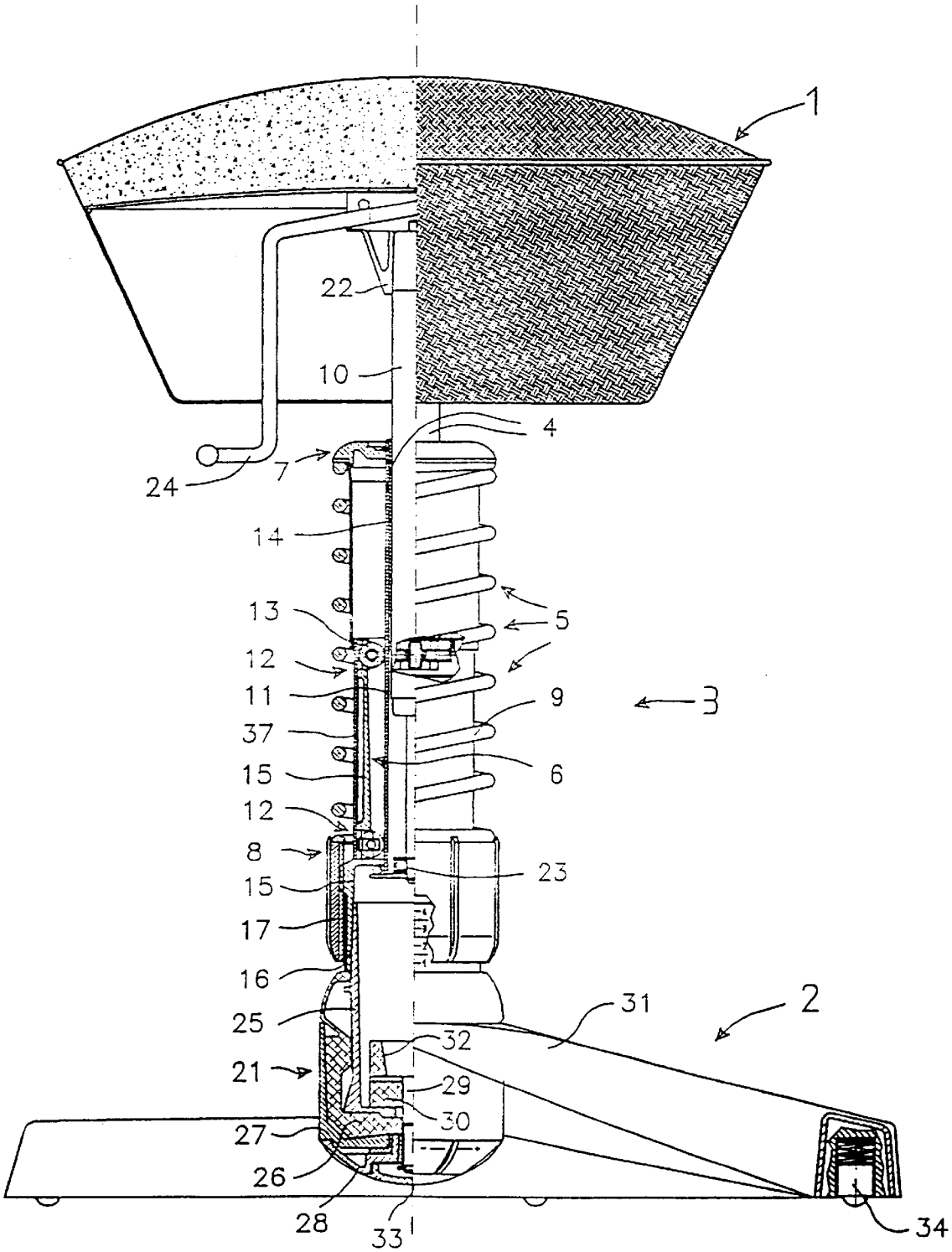

FIG. 1 shows a side view, half in section, of a rocking stool comprising a seat portion 1, an intermediate portion 3 and a base portion 2. The intermediate portion 3 has a central column or pillar 4 and a spring structure 5 and is held tiltably and returnably at its lower end in the base portion 2. The central pillar 4 is in the form of a height-adjustable spring pillar 10, generally in the form of a gas spring. The seat portion 1 is fixedly connected to the spring pillar 10 by way of a push-in connection 22 and can rotate about the longitudinal axis of the spring pillar 10 by virtue of the provision of a bearing 23 at the lower end of the spring pillar 10. For adjustment in respect of height of the seat surface 1, arranged at the underside is a lever 24 which, upon actuation, acts on the spring pillar in such a way that it can be adjusted in respect to height in known manner. The central pillar 4 also includes a vertical guide track 11 which is in the form of a tube surrounding the spring pillar 10 and which is rotatably connected at the lower end to the spring pillar 10 by way of the bearing 23.

To achieve the desired active-dynamic seating characteristics the spring structure 5 is connected in series subsequently to the central pillar 4 in the flow of force. A reversed arrangement in which the flow of force occurs firstly by way of the spring structure and then by way of the central pillar is equally possible.

The spring structure 5 comprises a static spring mounting 8, a spring 9 and a dynamic spring mounting 7. The dynamic spring mounting 7 is fixedly connected to the upper end of the guide track 11. A bearing guide 6 is provided between the spring structure 5 and the guide track 11, for the relative movement between the central pillar 4 and the spring structure 5. In the illustrated embodiment the bearing guide 6 comprises two bearing means 12 which are held in the upper holding part of a support leg main body 15. The support leg main body 15 forms the lower end of the central pillar 4 and is fitted by way of spline connection 16 onto the structure of the base portion 2. In its lower region the support leg main body 15 has a male screwthread onto which is screwed a union nut 17 which serves at the same time as a support means for the spring 9. The spring 9 can be prestressed by the union nut 17 and in that way the distance by which the seat surface 1 moves downwardly when the seat surface is loaded can be matched to the weight of the person using the stool.

The intermediate portion 3 is fitted by way of the spline connection 16 onto a return device 21 on the base portion 2. The return device 21 is in the form of a rubber-metal swing connection and comprises a substantially tubular upper portion 25 whose upper end serves for making the spline connection 16, a lower portion 27 which is fixedly secured to an arm 31 of the base portion 2, and an elastic material 26 arranged between the upper portion 25 and the lower portion 27. The lower portion 27 embraces the upper portion 25 in a cup-like configuration, while the elastic material 26 is arranged not only between the ends but also between the side walls. The upper portion 25 and the lower portion 27 are connected together by way of a screw 29, while the return device 21 can be prestressed by way of an adjusting nut 28 co-operating with the screw 29, and thus the return force can be adjusted. In an alternative configuration as shown in FIG. 1, arranged between the head of the screw 29 and the upper portion 25 is a further elastic element 30 which makes the characteristics of the return device 21 softer and more comfortable. The base portion 2 is generally in the form of an almost closed ring on which the return device 21 and thus the intermediate portion and the seat portion are mounted centrally by way of the arm 31. When a loading is applied the arm 31 is elastically deformed so that the rocking stool is pressed against the floor or ground by way of a friction-promoting contact device 33 at the lower end of the return device 21.

Arranged in the annular base portion 2 of the rocking stool are rollers or balls 34 which are resiliently retracted into the base portion 2 when a loading is applied. It would also be possible to use so-called rollers or balls in accordance with the DIN standard which are arrested in the resiliently extended condition, which permit displacement of the rocking stool upon a light loading being applied, and which are resiliently retracted into the base portion 2 when fully loaded.

Figure 2:
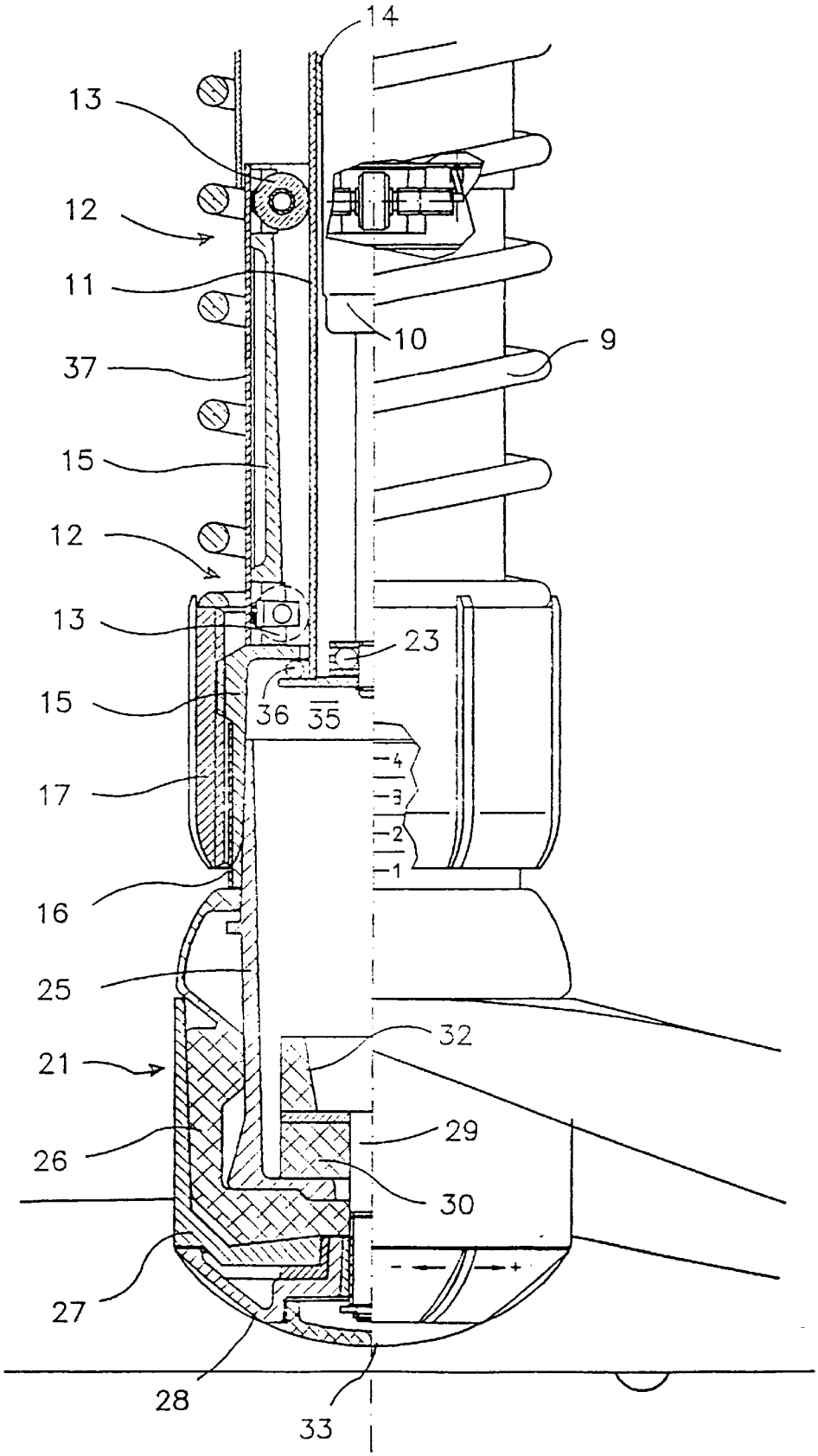

FIG. 2 shows the lower part of the intermediate portion 3 and the return device 21 of the rocking stool of FIG. 1 on an enlarged scale. Upon active-dynamic swinging movement about the longitudinal axis of the intermediate portion 3, a relative movement occurs between the guide track 11 and the spring structure 5. That relative movement is made possible by virtue of the above-mentioned bearing guide 6 between the spring structure 5 and the guide track 11. That bearing guide is described in greater detail in the following Figures. In the extended condition the travel of the spring 9 is limited by an abutment 35 at the lower end of the vertical guide track 11. The abutment 35 co-operates with a step or shoulder on the support leg main body 15. In order to make the travel limitation effect upwardly sound-less, a rubber ring 36 is operatively disposed between the support leg main body 15 and the abutment 35. An elastic abutment 32 is provided for travel limitation purposes in a downward direction, above the head of the screw 29.

Figure 3:
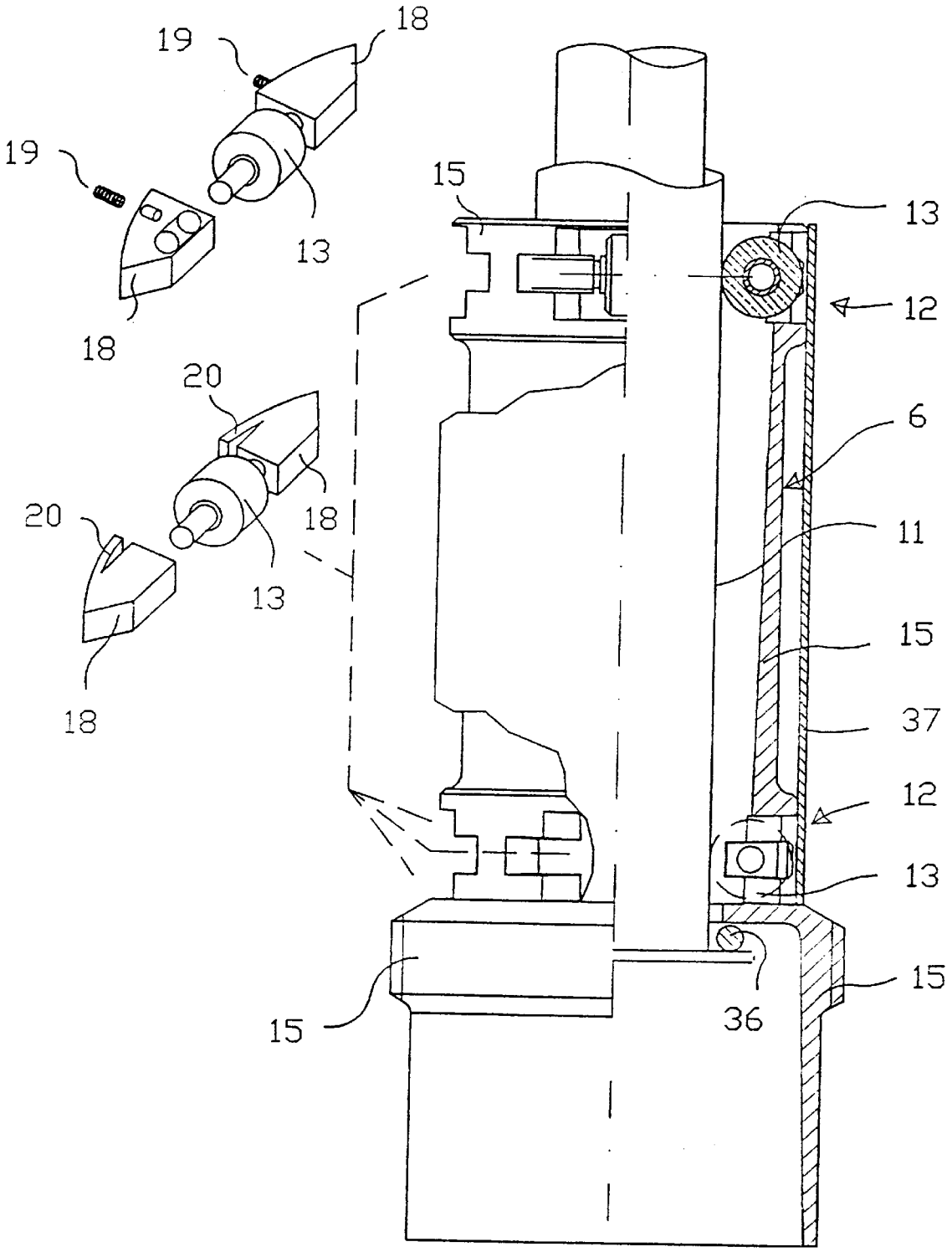

FIG. 3 shows the part of the intermediate portion in which the bearing guide 6 is disposed. In the illustrated embodiment the bearing guide 6 comprises two bearing means 12 which are held in the support leg main body 15 and which co-operate with the guide track 11. For each plane the bearing means 12 each have four bearing elements 13 which are distributed around the periphery of the guide track 11, which bearing elements 13 can be either in the form of rollers or balls (see in that respect also FIG. 4*a*). In the illustrated embodiment the bearing elements 13 are in the form of rollers, the roller shafts or spindles of which are accommodated at both sides in bearing element mountings 18. The bearing element mountings 18 are held radially displaceably to a certain degree in the support leg main body 15 and are spring-loaded in the direction of the guide track 11. Two alternative configurations are shown for providing for the spring loading. In the first alternative configuration the bearing element mountings 18 are supported by way of compression springs 19 against a tube 37 surrounding the support leg main body 5 and thereby urge the bearing elements 13 in the direction of the guide track 11. The tube 37 is fitted from above over the upper tubular region of the support leg main body 15 and cooperates with the support leg main body 15 for fixing bearing means 12.

In the second embodiment each of the bearing element mountings 18 has a respective elastic projection 20 which, by virtue of elastic deformation thereof, also urges the bearing element mountings 18 and therewith the bearing elements 13 against the guide track 11.

Figure 4A:
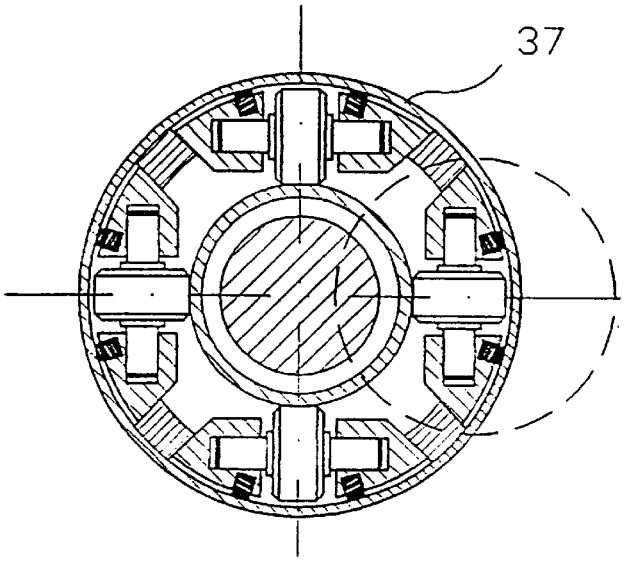

FIG. 4*a* is a view in section through the bearing means 12 already described above with reference to FIG. 3, FIG. 4*b* shows a portion on an enlarged scale from FIG. 4*a*, that alternative configuration showing the spring loading applied to the bearing elements 13 by way of compression springs 19 which bear against the tube 37.

Figure 4C:
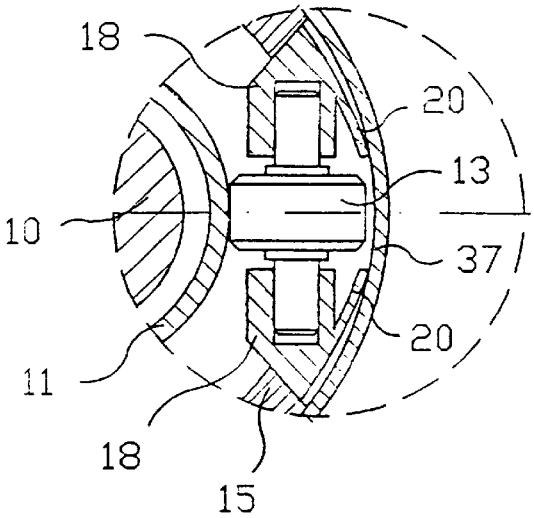
Figure 4B:
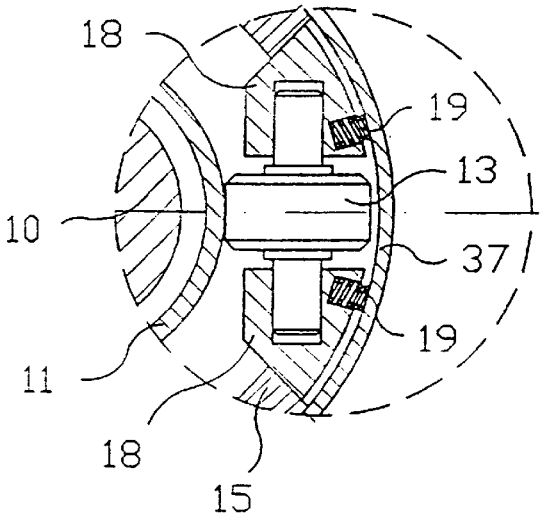

FIG. 4*c* shows the same part as in FIG. 4*b*, but illustrating another alternative configuration. In FIG. 4*c* the bearing mountings 18 have the elastic projection 20 which is also supported against the tube 37 and thus urges the bearing elements 13 against the guide track 11.

The invention is not limited to the illustrated embodiment. Thus it is also possible to adopt a parallel arrangement of the spring and the central pillar in the form of a telescopic pillar or column, between the seat portion and the base portion, when using the bearing guide according to the invention. In regard to the bearing guide, it is possible to provide for example a plurality of bearing elements which are arranged at regular vertical spacings and which are each turned through an angular amount.

I claim:

1. A rocking stool comprising:

a seat portion;

a base portion;

an intermediate portion mounted for tiltable movement relative to the base portion and comprising a central pillar and a spring structure, the central pillar and the spring structure being connected in series in a direction coinciding with a flow of force existing between the seat portion and the base portion when weight is impressed upon the seat portion; and a bearing guide provided between the central pillar and the spring structure; the central pillar and the spring structure being arranged concentrically, the spring structure comprising a dynamic spring mounting, a static spring mounting, and a spring operatively disposed between the mountings.

2. A rocking stool as set forth in claim 1, wherein the bearing guide is arranged on a support leg main body.

3. A rocking stool as set forth in claim 2, wherein the bearing mountings are radially displaceably held in the support leg main body.

4. A rocking stool as set forth in claim 3, wherein a rotatable union nut is provided as a spring support means on the support leg main body, by way of which nut the spring can be prestressed.

5. A rocking stool as set forth in claim 2, wherein the support leg main body is mountable on the base portion by way of a spline connection.

6. A rocking stool as set forth in claim 5, wherein a rotatable union nut is provided as a spring support means on the support leg main body, by way of which nut the spring can be prestressed.

7. A rocking stool as set forth in claim 2, wherein a rotatable union nut is provided as a spring support means on the support leg main body, by way of which nut the spring can be prestressed.

8. A rocking stool as set forth in claim 1, wherein a spacing between the dynamic spring mounting and the static spring mounting is adjustable.

9. A rocking stool as set forth in claim 8, wherein a rotatable union nut is provided as a spring support means on the support leg main body, by way of which nut the spring can be prestressed.

10. A rocking stool as set forth in claim 1, wherein a return device in the form of a rubber-metal swing connector is provided between the intermediate portion and the base portion.

11. A rocking stool as set forth claim 10, wherein the return force of the return device is adjustable.

12. A rocking stool as set forth in claim 10, wherein the intermediate portion is tiltable about a point in the base portion.

13. A rocking stool comprising:

a seat portion;

a base portion;

an intermediate portion mounted for tiltable movement relative to the base portion and comprising a central pillar and a spring structure, the central pillar and the spring structure being connected in series in a direction coinciding with a flow of force existing between the seat portion and the base portion when weight is impressed upon the seat portion; and a bearing guide provided between the central pillar and the spring structure;

the central pillar being a spring pillar with at least one vertical guide track cooperating with the bearing guide.

14. A rocking stool as set forth in claim 13, characterised in that the spring pillar is adjustable in respect of its length.

15. A rocking stool as set forth in claim 13, wherein the guide track is a tube having a first end is connected to the lower end of the spring pillar and a second end connected to the dynamic spring mounting.

16. A rocking stool comprising:

a seat portion;

a base portion;

an intermediate portion mounted for tiltable movement relative to the base portion and comprising a central pillar and a spring structure the central pillar and the spring structure being connected in series in a direction coinciding with a flow of force existing between the seat portion and the base portion when weight is impressed upon the seat portion; and a bearing guide provided between the central pillar and the spring structure; the bearing guide including an at least two-part bearing means arranged in spaced apart relation.

17. A rocking stool as set forth in claim 16, wherein at least two bearing elements are arranged on the guide track for each bearing means.

18. A rocking stool as set forth in claim 17, wherein the bearing elements are biased against the guide track.

19. A rocking stool as set forth in claim 17, wherein the bearing elements are held in bearing element mountings.

20. A rocking stool as set forth in claim 19, characterised in that the bearing element mountings press the bearing elements against the guide track by way of compression springs.

21. A rocking stool as set forth in claim 19, wherein the bearing element mountings have an elastically deformable region and bias the bearing elements against the guide track by virtue of the elastic deformation.

22. A rocking stool as set forth in claim 19, wherein the bearing element mountings have an elastically deformable projection Which biases the bearing elements against the guide track.

* * * * *